United States Patent [19]

Hurley

[11] 3,985,219

[45] Oct. 12, 1976

[54] RIBBON CARTRIDGE FOR AUTOMATIC TYPEWRITER FUNCTION

[75] Inventor: Edwin J. Hurley, Cortland, N.Y.

[73] Assignee: SCM Corporation, New York, N.Y.

[22] Filed: June 23, 1975

[21] Appl. No.: 589,645

[52] U.S. Cl. ..... 197/151; 197/181

[51] Int. Cl.[2] ..... B41J 33/02; B41J 19/62

[58] Field of Search ..... 197/82, 83, 91, 151, 197/168, 169, 181, 107, 6.7; 242/55, 57

[56] References Cited

UNITED STATES PATENTS

| | | | |
|---|---|---|---|
| 1,475,619 | 11/1923 | Barney | 197/51 |
| 1,608,279 | 11/1926 | Handley | 197/51 |
| 3,194,379 | 7/1965 | Szeluga | 197/151 |
| 3,204,746 | 9/1965 | Wolowitz | 197/181 X |
| 3,346,090 | 10/1967 | Goff et al. | 197/158 |
| 3,632,052 | 1/1972 | Read | 197/160 X |
| 3,637,060 | 1/1972 | McMahon | 197/6.7 |
| 3,643,778 | 2/1972 | Anderson | 197/151 |
| 3,729,081 | 4/1973 | Ozimek et al. | 197/181 X |
| 3,804,227 | 4/1974 | Cappotto et al. | 197/151 |
| 3,882,990 | 5/1975 | Genesio | 197/181 |
| 3,927,746 | 12/1975 | Wolowitz | 197/151 |
| 3,927,747 | 12/1975 | Wolowitz | 197/151 |
| 3,927,748 | 12/1975 | Wolowitz | 197/181 |
| 3,927,749 | 12/1975 | Wolowitz | 197/181 |

*Primary Examiner*—Edgar S. Burr
*Assistant Examiner*—Paul T. Sewell
*Attorney, Agent, or Firm*—Stanley J. Klem; Milton M. Wolson

[57] ABSTRACT

A typewriter ribbon cartridge carrying at least one abutment thereon for engaging one or more typewriter functions and responsive means or mechanism to thereby actuate the typewriter function mechanism when the ribbon cartridge is inserted into the typewriter.

12 Claims, 7 Drawing Figures

RIBBON CARTRIDGE FOR AUTOMATIC TYPEWRITER FUNCTION

BACKGROUND OF THE INVENTION

The present invention relates generally to insertable and removable typewriter ribbon cartridges of the type disclosed in U.S. Pat. No. 3,643,777 entitled TYPEWRITER RIBBON CARTRIDGE granted on Feb. 22, 1972 and U.S. Pat. Application Ser. No. 150,946 filed June 9, 1971 entitled TYPEWRITER RIBBON CARTRIDGE both of which are assigned to the assignee of the instant application. The present invention cooperates with a typewriter mechanism that is clearly described in co-pending U.S. Patent Application entitled AUTOMATIC FUNCTION MECHANISM FOR TYPEWRITERS filed simultaneously with the instant application with Edwin J. Hurley as sole inventor and assigned to the same assignee. The invention in its broadest aspects is not restricted to this cartridge structure, but has been illustrated and described for explanatory purposes and could readily be adapted to other cartridge housings or any other typewriter ribbon holder. The term "cartridge" as used hereinafter is defined to include any form of ribbon holder or container irrespective of configuration and the manner of insertion into the typewriter. The ribbon cartridge of the present invention may include an error correction ribbon disposed therein whereby the correction ribbon is guided from the correction ribbon cartridge supply chamber along an integral ribbon guide arm that extends from the correction ribbon cartridge supply chamber to the typewriter print station. More specifically, the present invention is concerned with a ribbon cartridge construction that includes a pair of abutments thereon to engage a backspace coupled responsive member and an escapement coupled responsive member when the ribbon cartridge is inserted into the typewriter, thereby actuating the backspace mechanism to reposition the typewriter carriage to the previous print station and to disable the escapement mechanism to prevent further carriage movement. One of the many useful applications of the present invention resides in the provision of an error correction ribbon within the cartridge. The correction of errors in typewriters as disclosed in the prior art in general require a series of sequential manually manipulative operations so that the carriage of the typewriter may be backspaced a plurality of times to correct the error. For example, when an operator typed an erroneous character, it first became necessary to manually depress the backspace key, thereby actuating the backspace mechanism to reposition the typewriter carriage to the proper print station for making the correction. After the erroneous typed character is removed by striking over the character through the correction ribbon, the backspace key was again manually depressed to actuate the backspace mechanism a second time. The typewriter carriage is repositioned to the proper printing station a second time and then the correct character is typed. Therefore, a series of manually manipulative operations by the operator were necessary to correct an erroneously typed character. The end result of the foregoing disadvantages of the prior art is that typing speed is significantly reduced, total typing time is increased and the possibility of compounding the error by inadvertent multiple backspacing is increased.

The present invention as applied to error correction overcomes the obvious disadvantages of the prior art in that the manual manipulation required to actuate the backspace mechanism and reposition the typewriter carriage to the proper print station is accomplished automatically by inserting the ribbon cartridge.

SUMMARY OF THE INVENTION

The inventive concept of the present invention contemplates a ribbon cartridge which is so structured that upon its insertion into a typewriter, it will actuate one or more typewriter functions.

The term "typewriter function" is defined to include any typewriter operation which provides for the alignment of a selected platen impact point relative to the typewriter print point.

One physical embodiment of the concept comprises a ribbon cartridge which includes a pair of abutments that project from opposite vertical walls of the ribbon cartridge. One abutment engages a typewriter responsive lever that is coupled to the backspace mechanism while the other abutment engages a typewriter responsive lever that is coupled to the escapement mechanism within the typewriter. The abutments are disposed on the ribbon cartridge wall in such a manner that they abut and actuate the levers within the typewriter as the ribbon cartridge is inserted into the typewriter for error correction. Upon abutment engagement, the levers are urged to pivot downward and one being coupled to the backspace mechanism, actuates the backspace mechanism to reposition the typewriter carriage to the proper print station for correction of an erroneously typed character. The other lever actuates an escapement disabling mechanism to prevent movement of the typewriter carriage from the proper print station. Upon removal of the ribbon cartridge the escapement mechanism returns to its operational mode.

Although the physical embodiment of the invention has been directed to one application, namely, backspacing and escapement disabling for error correction, it is clear that it could actuate a variety of typewriter functions, either singly, in combination or sequentially. Such functions may include carriage return, shift, and margin release.

Accordingly, it is an object of the present invention to provide a simple inexpensive and reliable cartridge which upon insertion into a typewriter will automatically actuate one or more selected typewriter functions.

Another object of the present invention is to provide a cartridge for a typewriter that will automatically actuate the typewriter backspace mechanism when the cartridge is inserted into the typewriter.

Still another object of the present invention is to provide a cartridge for a typewriter that will automatically actuate an escapement disabling mechanism when the cartridge is inserted into the typewriter.

A further object of the present invention is to provide a simple and inexpensive means for adapting an existing ribbon cartridge to automatically actuate a typewriter function such as the backspace mechanism and/or an escapement disabling mechanism.

Other objects, features, and advantages of the invention will become more apparent from the following description, including appended claims, and accompanying drawing.

DESCRIPTION OF THE PREFERRED EMBODIMENT

Although the inventive concept may be illustrated in conjunction with a variety of typewriter functions, the following embodiment has, for the purpose of clarity and ease of description, been confined to a common and readily employed function, namely, backspacing and error correction. The principle of this invention can be readily applied to other typewriter functions utilizing the embodiments described herein as examples.

Figure 1:
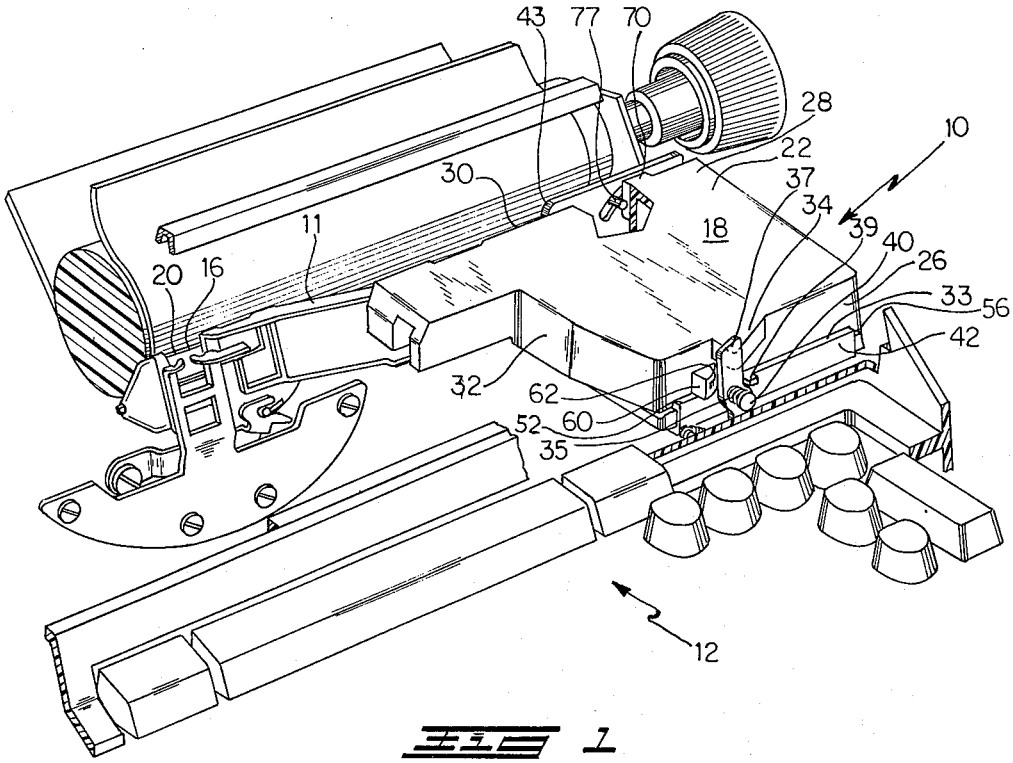
FIG. 1 is a perspective view of a portion of a typewriter having inserted therein a cartridge embodying the instant invention.
Figure 2:
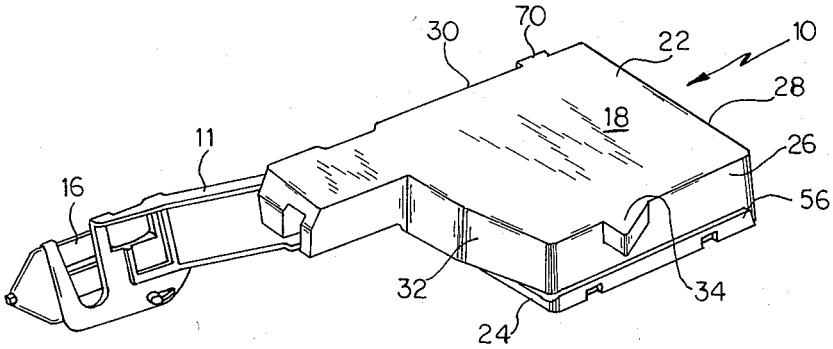
FIG. 2 is a rear perspective view of an embodiment of a cartridge showing the backspace actuating means made in accordance with the instant invention.

Referring now to the drawings and in particular to FIGS. 1 and 2 showing the ribbon cartridge 10 having an arm 11 extending therefrom, positioned in a typewriter 12. An error correction ribbon 16 is disposed in a housing 18 of ribbon cartridge 10 and guided along arm 11 to the typewriter print station 20 and then back to housing 18. The internal construction of ribbon cartridge 10 is fully described in the previously mentioned patents and patent applications, and is illustrative of one type of cartridge to which the inventive concept may be applied.

The ribbon cartridge housing 18 is comprised of a top 22 and a base 24 spaced from top 22 by depending walls 26, 28, 30, and 32.

The inventive concept as illustrated is applied in one particular embodiment to a specific cartridge for the sake of illustrative clarity and may take other forms as well as be adaptable to other types of cartridges.

Disposed at the uppermost portion of wall 26 is a projecting abutment 34. Abutment 34 projects outward from wall 26 to an extent that its path of travel during ribbon cartridge insertion will intersect and strike a typewriter backspace actuating mechanism that is fully disclosed in the co-pending patent application mentioned above.

Figure 3:
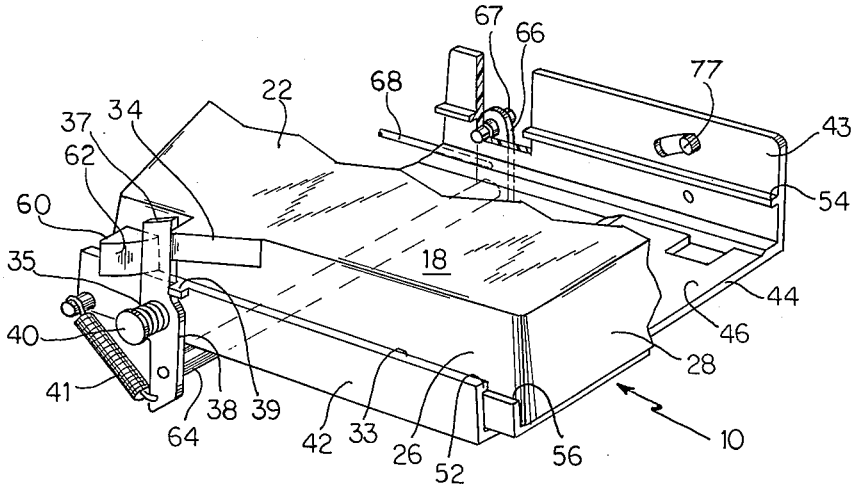
FIG. 3 is an enlarged rear perspective view of a portion of the cartridge illustrating its relation to the backspace actuating mechanism of the typewriter as the cartridge is being inserted into the typewriter.
Figure 4:
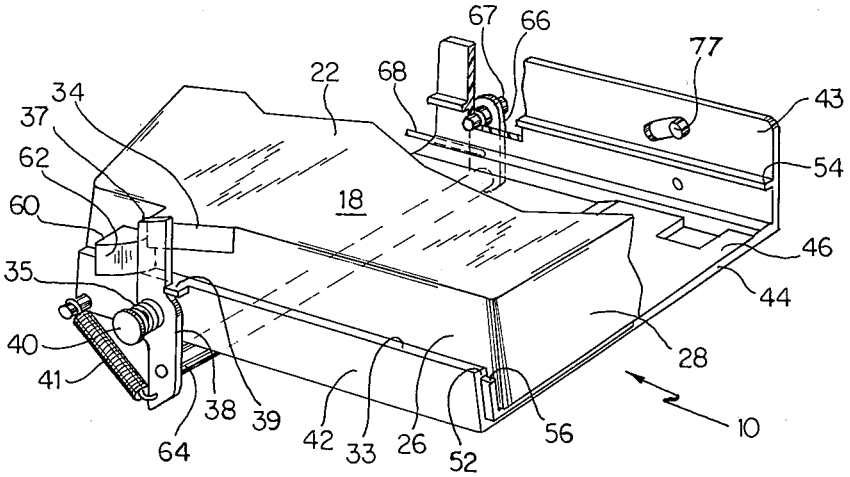
FIG. 4 is a view as shown in FIG. 3 with the cartridge at its fully inserted station.

Typewriter 12 is provided with means for actuating its backspace function that may be disposed proximate the opening that receives the ribbon cartridge 10 as shown in FIGS. 3 and 4. The means for actuating the backspace function includes a lever 38 that is pivotally and slideably supported about a pivot shaft 40 that is carried by a wall 42 of ribbon cartridge platform 44. Ribbon cartridge platform 44 is fixed within typewriter 12 preferably in a horizontal plane. Ribbon cartridge platform 44 supports and guides ribbon cartridge 10 during insertion and removal from typewriter 12, and is of the type described in the above referred to patent application assigned to the present assignee or may be readily adapted to accept a variety of structurally different cartridges. The structure of ribbon cartridge platform 44 includes a flat base 46 having a pair of integral walls 42 and 43 extending upwards therefrom. Walls 42 and 43 are parallel to and spaced from one another to provide precise guiding for the insertion of ribbon cartridge 10. Walls 42 and 43 include opposed overhanging retaining shelves 52 and 54 which overlie cooperating ledges 56 and 58 of ribbon cartridge 10 to prevent upward movement of the cartridge when it is inserted into the typewriter 12. An integral upstanding camming abutment 60 is disposed on a top edge 33 of wall 42. As shown in FIGS. 1, 3, and 4, abutment 60 is positioned adjacent lever 38. The actuable mode of lever 38, best shown in FIG. 3, exists as it is biased into abutment with a stop 39 by a spring 41 and the backspace mechanism is inoperative. Therefore, as error correction ribbon cartridge 10 is inserted into typewriter 12, abutment 34 abuts and urges an upper extension 37 of lever 38 to progressively slide along a camming surface 62 of abutment 60.

Counterclockwise movement of lever 38, as shown in FIGS. 3 and 4, pivotally displaces an arm 66 by way of a common connecting rod 64 to linearly displace link 68 to which it is attached. Arm 66 is pivotally and slideably supported about a pivot shaft 67 that is carried on wall 43 of ribbon cartridge platform 44. The length of pivot shaft 67 is sufficient to allow arm 66 to be displaced either inwardly or outwardly in relation to wall 43. As extension 37 moves along abutment camming surface 62, lever 38 is displaced outwardly of wall 42 and axially along pivot 40 thereby compressing axial spring 35 until lever 38 is displaced beyond the uppermost portion of abutment 60, at which time, lever 38 is urged by spring 41 to return to its actuable mode. As lever 38 pivots and is displaced outwardly, connecting rod 64 is linearly displaced commensurate with the outward displacement of lever 38, and arm 66, being fixed to connecting rod 64 is displaced inwardly a commensurate distance. This movement results in displacing link 68 which in turn actuates the typewriter backspace function.

Figure 5:
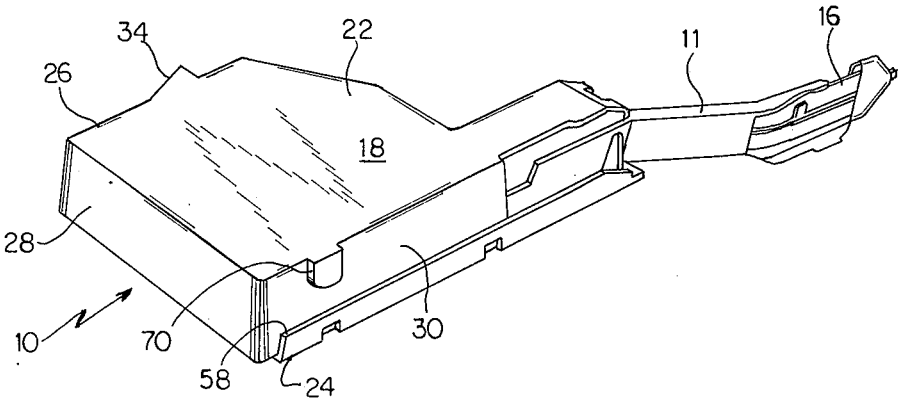
FIG. 5 is a rear perspective view of an embodiment of a cartridge showing the escapement disabling actuating means made in accordance with the instant invention.
Figure 6:
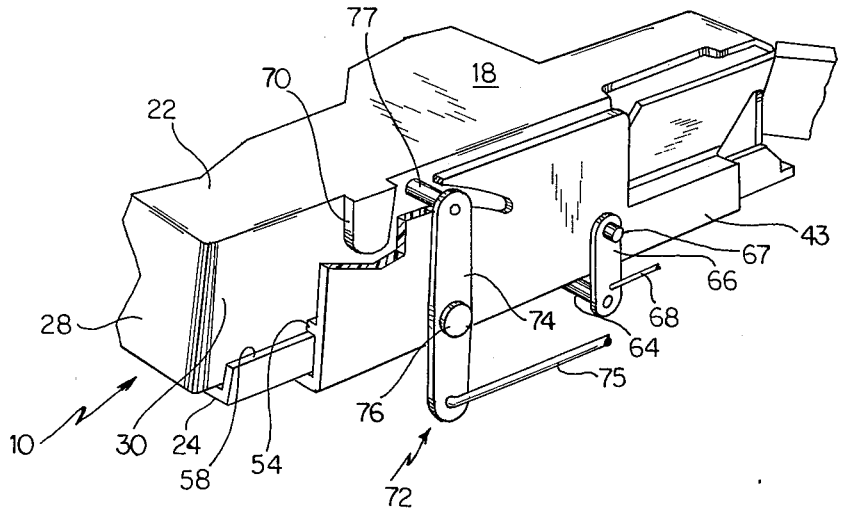
FIG. 6 is an enlarged rear perspective view of a portion of the ribbon cartridge in relation to the escapement disabling mechanism of the typewriter as the ribbon cartridge is being inserted.
Figure 7:
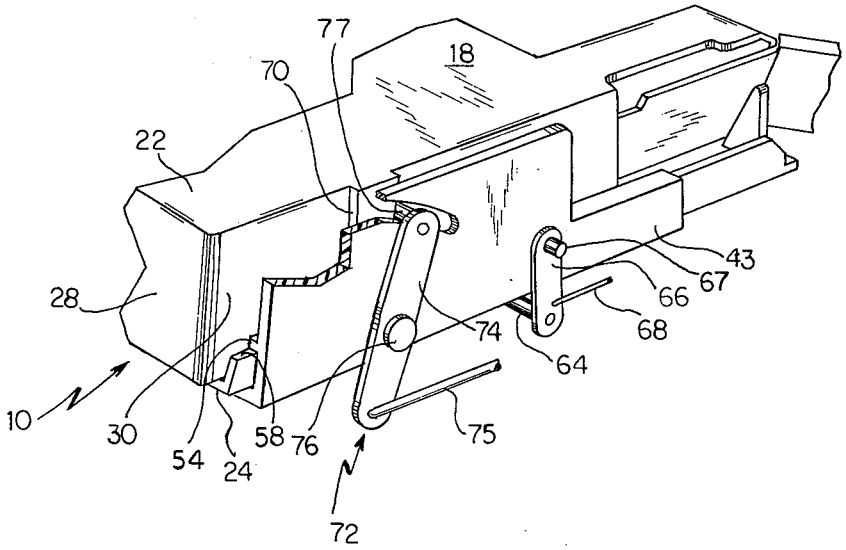
FIG. 7 is a view as shown in FIG. 6 with the ribbon cartridge at its fully inserted station.

Disposed at the uppermost portion of an opposite ribbon cartridge wall 30 is a second projecting abutment 70 best shown in FIGS. 5, 6, and 7. Abutment 70 projects outward from wall 30 to an extent that its path of travel during ribbon cartridge insertion will intersect a typewriter escapement disabling actuating mechanism. The details of construction of the escapement disabling actuating mechanism 72 will not be elaborated on herein as much as it is fully disclosed in the simultaneously filed co-pending patent application mentioned above.

Typewriter 12 is further provided with means for actuating the escapement disabling mechanism that may be disposed proximate the opening opposite backspace actuating cartridge abutment 34. The means for actuating the escapement disabling mechanism best shown in FIGS. 1, 6, and 7, and includes a lever 74 that is pivotally supported about a pivot shaft 76 supported on a wall 43 of ribbon cartridge platform 44.

When error correction ribbon cartridge 10 is inserted into typewriter 12, abutment 70 abuts a projecting pin 77 of lever 74 and urges lever 74 to pivot clockwise about pivot 76 as shown in FIG. 7. Clockwise movement of lever 74 pulls a link 75 which is connected in a manner so as to disable the typewriter escapement mechanism. The typewriter escapement mechanism will remain disabled since abutment 70 holds lever 74 in its actuated mode until ribbon cartridge 30 is removed. Under the biasing action of the disabling mechanism, the lever 74 will then return to its inoperable or actuable position as shown in FIG. 6.

When error correction ribbon cartridge 10 is removed from typewriter 12, the backspace actuating mechanism and the escapement disabling mechanism return to their inoperative states. As abutment 34 is removed from contact with lever 38, lever 38 is urged by spring 35 to move toward wall 42 until it is situated in its actuable mode. Due to an inwardly directed sloped surface 33 of abutment 34, it will pass by lever 38 without rotating it. As abutment 70 is removed from contact with pin 77, lever 74 is urged to return to its actuable position where the escapement mechanism is again operative.

It can be seen from the foregoing description that abutment 34 on error correction ribbon cartridge 10 engages a backspace actuating mechanism to automatically backspace the typewriter carriage 14 when the error correction ribbon cartridge 10 is inserted into typewriter 12. It can also be seen that a second abutment 70 on an opposite wall 30 of error correction ribbon cartridge 10 engages another actuating mechanism to automatically disable the typewriter escapement mechanism thereby preventing further carriage movement from the error correction station. Therefore, the instant invention eliminates the necessity of multiple manual backspace operations that are required in typewriters not equipped with automatic devices to backspace a carriage and disable an escapement mechanism when an erroneously typed character is to be corrected.

The illustrated embodiment has been shown with a pair of abutments to actuate two related functions, but it is clear that they may equally well be employed separately as well as being disposed along other surfaces of the cartridge.

While the foregoing description has shown and described the fundamental novel features as applied to a preferred embodiment, it will be understood by those skilled in the art that modifications embodied in various forms may be made without departing from the spirit and scope of the invention.

What is claimed is:

1. A ribbon cartridge for a typewriter, which typewriter includes means for receiving the cartridge and operational means to perform a typewriter function for causing the alignment of a selected platen impact point relative to the typewriter print point, the cartridge comprising:

means disposed on the cartridge for actuating the typewriter operational means upon insertion of the cartridge to thereby perform the typewriter function.

2. A cartridge as defined in claim 1 wherein said actuating means includes at least one abutment carried by the cartridge.

3. A ribbon cartridge as defined in claim 2 wherein said abutment is in the path of the operational means for actuating the typewriter function upon insertion of the ribbon cartridge.

4. A ribbon cartridge for a typewriter, which typewriter includes means for receiving the ribbon cartridge and operational means for backspacing a typewriter carriage, the ribbon cartridge comprising:

means disposed on the ribbon cartridge for actuating the typewriter operational means upon insertion of the ribbon cartridge to thereby perform a backspace function.

5. A ribbon cartridge for a typewriter, which typewriter includes an incrementally traversable carriage controlled by an escapement mechanism, operational means for disabling the escapement mechanism and means for receiving the ribbon cartridge comprising:

means disposed on the ribbon cartridge for actuating said operational means for disabling the escapement mechanism upon insertion of the ribbon cartridge.

6. A ribbon cartridge as defined in claim 5 wherein said actuating means includes an abutment carried on the ribbon cartridge.

7. A ribbon cartridge as defined in claim 6 wherein said abutment is in the path of the operational means for disabling the escapement mechanism upon insertion of the ribbon cartridge.

8. A ribbon cartridge for a typewriter which typewriter includes an incrementally traversable carriage controlled by an escapement mechanism, backspacing operational means for backspacing the typewriter carriage and escapement disabling operational means for disabling the escapement mechanism, the ribbon cartridge comprising:

means disposed on the ribbon cartridge for actuating the backspace operational means for actuating the typewriter backspacing means upon insertion of the ribbon cartridge; and means disposed on the ribbon cartridge for actuating the escapement disabling operational means for disabling the escapement mechanism upon insertion of the ribbon cartridge.

9. A ribbon cartridge as defined in claim 8 wherein said actuating means includes a pair of abutments carried on the ribbon cartridge.

10. A ribbon cartridge as defined in claim 9 wherein one of said abutments is in the path of the operational means for actuating the backspacing mechanism upon insertion of the ribbon cartridge.

11. A ribbon cartridge as defined in claim 10 wherein the other of said abutments is in the path of the operational means for disabling the escapement mechanism upon insertion of the ribbon cartridge.

12. A ribbon cartridge as defined in claim 8 wherein said actuating means are carried on opposite walls of the ribbon cartridge.

* * * * *